United States Patent [19]

Aoki et al.

[11] 4,337,697

[45] Jul. 6, 1982

[54] SERIAL PRINTER

[75] Inventors: Masatsugu Aoki, Yokohama; Yasuhiko Iwane, Tamayama, both of Japan

[73] Assignee: Alps Electric Co., Ltd., Tokyo, Japan

[21] Appl. No.: 107,528

[22] Filed: Dec. 27, 1979

[30] Foreign Application Priority Data

Dec. 30, 1978 [JP] Japan ..... 53-164159

[51] Int. Cl.[3] ..... B41J 9/08

[52] U.S. Cl. ..... 101/93.48; 101/93.11; 101/93.17; 400/247

[58] Field of Search ..... 101/93.15, 93.48, 93.16, 101/93.11, 93.17, 93.09; 400/247, 662, 661.3

[56] References Cited

U.S. PATENT DOCUMENTS

| | | | |
|---|---|---|---|
| 2,094,550 | 9/1937 | O'Halloran | 400/247 |
| 2,409,237 | 10/1946 | Banks | 400/247 |
| 2,502,491 | 4/1950 | Thompson | 400/157.1 |
| 3,332,343 | 7/1967 | Sims, Jr. | 101/93.16 |
| 4,051,942 | 10/1977 | Suzuki et al. | 101/93.16 |

FOREIGN PATENT DOCUMENTS

| | | | |
|---|---|---|---|
| 2830226 | 2/1979 | Fed. Rep. of Germany | 101/93.09 |
| 2830227 | 2/1979 | Fed. Rep. of Germany | 101/93.09 |
| 53-2118 | 1/1978 | Japan . | |

OTHER PUBLICATIONS

Hosez, "Typing Shield", IBM Technical Disclosure Bulletin, vol. 5, No. 11, pp. 30–31, 4/63.

Heydkamp et al., "Printing Hammer Arrangement", IBM Technical Disclosure Bulletin", vol. 9, No. 8, pp. 1013–1014, 1/67.

*Primary Examiner*—William Pieprz

*Attorney, Agent, or Firm*—Guy W. Shoup; Gerard F. Dunne

[57] ABSTRACT

A printer for printing function symbols and numerals, characterized by comprising a type wheel for printing numerals which can rotate with a rotary shaft and which can move in the axial direction of the rotary shaft, a type wheel for printing function symbols which can rotate with the rotary shaft and which can move in the axial direction of the rotary shaft, and a print hammer whose printing face is provided with a groove and which is arranged in opposition to the type wheels, so that when either one of the type wheels lies in a printing position, the other type wheel is confronted to the groove of the printing face.

10 Claims, 3 Drawing Figures

SERIAL PRINTER

BACKGROUND OF THE INVENTION

The present invention relates to a printer, and more particularly to a printer which can serially print a function digit and numeral digits.

Recently, small-sized desk calculators or measuring instruments have been additionally provided with a small-sized and light-weight printer, and it has become possible to immediately print a displayed result on recording paper. Regarding contents to be printed on the recording paper, not only the counted numerical result but also a function digit can be usually printed. The prior-art printer which can print the numeral digits and the function digit in this manner typically comprise a type wheel which has type elements corresponding to various function symbols disposed on its periphery, as well as a type wheel which has type elements corresponding to numerals disposed on its periphery, and two print hammers which correspond to the respective type wheels. In operation, a function digit is printed with the first hammer, whereupon the printing operation for the function digit is ceased. Subsequently, the second print hammer is actuated and is successively shifted from the least significant digit of the numeral digits so as to print the predetermined numerical value.

In this manner, the prior-art printer is equipped with two hammers for printing the function digit and for printing the numerical value, respectively, and operates only one of them at a time through the control of a change-over mechanism. It is therefore disadvantageous in that a driver mechanism for the hammers becomes considerably complicated and that the assemblage is cumbersome. Other disadvantages are frequent operating troubles and very high cost.

SUMMARY OF THE INVENTION

It is therefore an object of the present invention to provide a printer capable of printing a function digit and numeral digits, wherein the printing of the function digit and the printing of the numeral digits can be performed by the use of a single print hammer.

According to one aspect of performance of the present invention, there is provided a serial printer wherein printing is sequentially performed by moving a type wheel along a line to be printed. The serial printer comprises first and second type wheels which are mounted on a rotary shaft and which are movable in an axial direction of said rotary shaft; a single hammer opposed to said first and second type wheels and which extends over all digits to-be-printed in said axial direction of said rotary shaft. The hammer has a printing face for striking said first or second type wheel and a recess formed in a part of said printing face; and a mask member which is interposed between said recess of said hammer and said first or second type wheel; whereby when either one of said type wheels is opposed to said printing face of said hammer, the other type wheel opposes said recess of said hammer through said mask member.

The above-mentioned and other objects and features of the present invention will become apparent from the following detailed description taken in conjunction with the accompanying drawings.

DESCRIPTION OF THE PREFERRED EMBODIMENT

Figure 1:
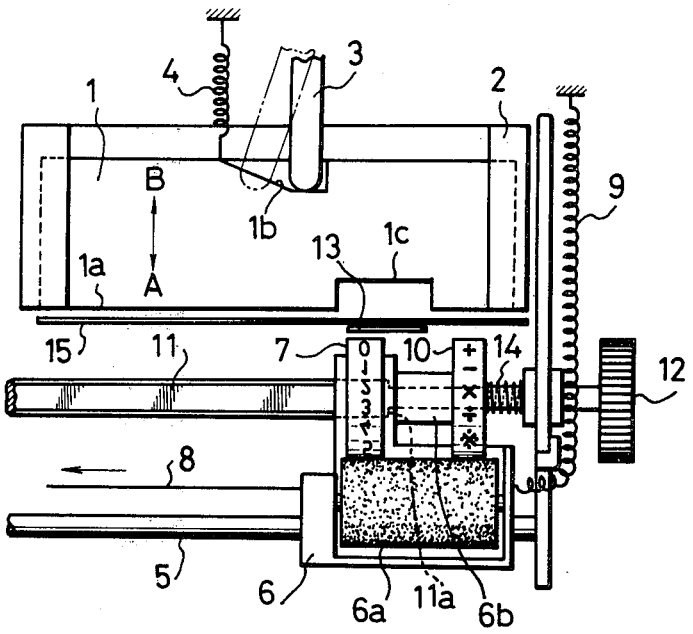
FIG. 1 is a front view of a serial printer embodying the present invention and shows the stand-by state thereof.

FIG. 1 is a top plan view of a printer according to the present invention. Referring to the figure, numeral 1 designates a print hammer which is in the shape of a thick plate and which is supported by a hammer guide 2 in a manner so as to be slidable in the directions of arrows A and B. The print hammer 1 has a hammer portion 1*a* in its front edge, and a cam portion 1*b* in its rear edge. In a part of the hammer portion 1*a*, a groove 1*c* is formed. The fore end of a lever 3 for driving the print hammer 1 is in engagement with the cam portion 1*b*. Numeral 4 designates a tension spring, which is normally pulling the print hammer 1 in the direction of the arrow B. Shown at 5 is a slide shaft which is disposed in the lengthwise direction of the print hammer 1. A carriage 6 is supported on the slide shaft 5 in a manner to be movable thereon. An ink roller 6*a* and a type wheel 7 provided with numeral type elements are held by the carriage 6 in such a manner that both are rotatable. Numeral 8 indicates a shifting cord which moves the carriage 6 leftwards from a position depicted in FIG. 1, while numeral 9 indicates a return spring which draws the carriage 6 back to the position of FIG. 1. Numeral 10 denotes a type wheel provided with function type elements, numeral 11 a rotary shaft for rotating the type wheels 7 and 10, and numeral 12 a gear for transmitting a turning force to the rotary shaft 11. Numeral 13 represents a mask which is made of an elastic metal sheet.

Figure 2:
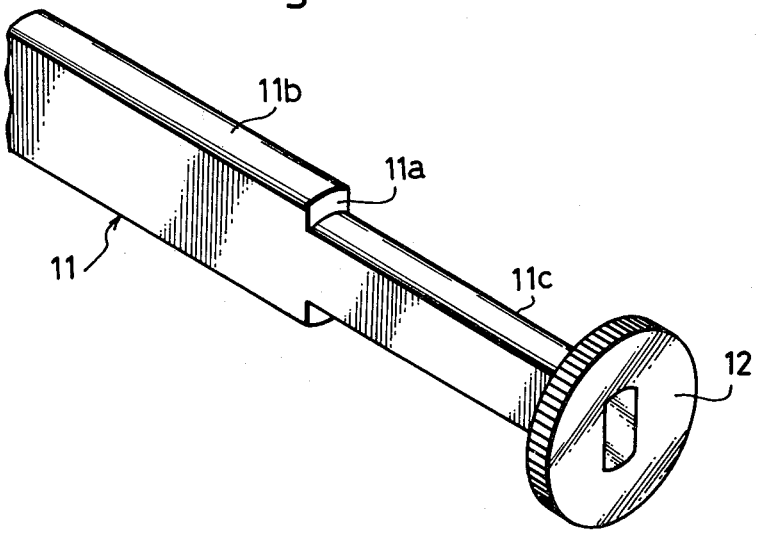
FIG. 2 is a perspective view of a rotary shaft for use in the embodiment.

The detailed construction of the rotary shaft 11 and the type wheels 7 and 10 which are rotated and driven by the rotary shaft will now be described. As shown in FIG. 2, the rotary shaft 11 has flat sides, and a stepped portion 11*a* is formed at an intermediate part. The type wheel 7 is loosely fitted on the large-diameter portion 11*b*, while the type wheel 10 is loosely fitted on the small-diameter portion 11*c*. Upon rotation of the rotary shaft 11, the type wheels 7 and 10 rotate therewith. Simultaneously, the type wheel 7 is movable on the large-diameter portion 11*b* in the axial direction, while the type wheel 10 is movable on the small-diameter portion 11*c* in the axial direction. In addition, the type wheel 10 is biased towards the stepped portion 11*a* by a spring 14 as shown in FIG. 1.

The state shown in FIG. 1 is a stand-by state in which the carriage 6 is located at its most right end position. Under this state, the type wheel 10 lies in a function symbol-printing position since a protrusion 6*b* of the carriage 6 urges the type wheel 10 rightwards, while the type wheel 7 held by the carriage 6 is opposed to the groove 1*c* formed in the print hammer 1. When, under this state, a solenoid or the like not shown is actuated to move the lever 3 to a position indicated by a dotted line, the print hammer 1 moves in the direction of the arrow A and strikes the recording paper 15 against a desired one of the function type elements disposed on the outer periphery of the type wheel 10, so as to print the desired function symbol. Since the type wheel 7 confronts the groove 1*c* during the function symbol-printing operation, no numeral is printed. The mask 13 inserted between the type wheel 7 and the recording paper 15 serves to prevent ink from adhering to the recording paper and staining it.

Figure 3:
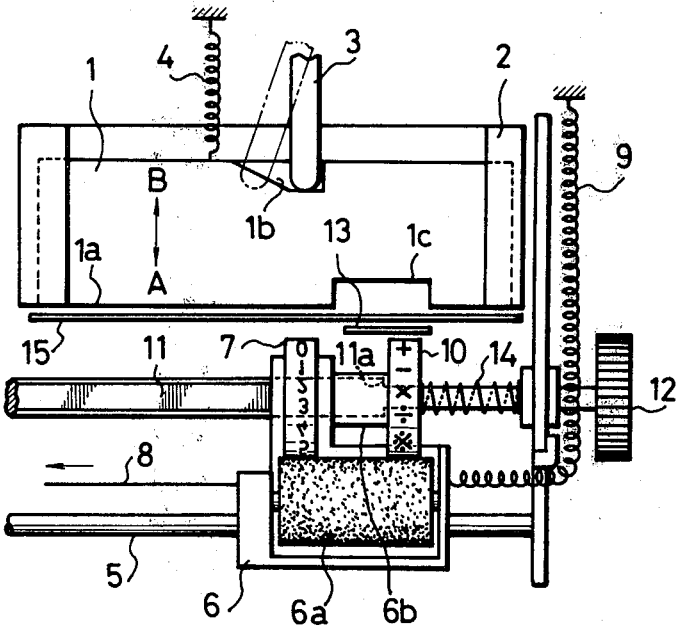
FIG. 3 is a front view of the embodiment showing the state in which a carriage is shifted by one digit.

Upon completion of the printing of a function digit, the shifting cord 8 is pulled in the direction of arrow, so that the carriage 6 moves leftwards into a position depicted in FIG. 3. Therefore, the protrusion 6*b* of the carriage 6 ceases engaging the type wheel 10, and the type wheel 10 is moved leftwards by the force of the spring 14 until it stops upon abutment against the stepped portion 11*a* of the rotary shaft 11 as illustrated in FIG. 3. Under this state, the type wheel 7 lies at a position corresponding to the first digit of a number to be printed, while the type wheel 10 lies at a position opposing the groove 1*c*. When the solenoid is actuated to move the lever 3 to the dotted-line position, the print hammer 1 projects in the direction of the arrow A and strikes the recording paper 15 against a desired one of numeral type elements disposed on the outer periphery of the type wheel 7, so as to print the numerical value of the first digit. During the numeral printing operation, the type wheel 10 confronts the groove 1*c*, and hence, no function symbol is printed.

Upon completion of the printing operation of the first digit, the type wheel 10 is left in place, and only the type wheel 7 held on the carriage 6 is further advanced leftwards by one digit. The printing of the second digit is performed in the same way as described above. If desired, numerals beyond the third digit are printed by the same operations.

Upon completion of the printing of a predetermined digit, the carriage 6 is unlocked, and it is returned into the stand-by state of FIG. 1 by the force of the return spring 9.

As described above in detail, the present invention disposes both the type wheel for printing numerals and the type wheel for printing function symbols in a manner to be movable in the axial direction of the rotary shaft and constructs them so that when either one of the type wheels lies in the printing position, the other type wheel may confront the groove provided in the print hammer. Therefore, whenever a type element is struck with the print hammer, type elements disposed on the other type wheel lie opposite the groove. Accordingly, when a function symbol is being printed a numeral can not be printed, and when a numeral is being printed a function symbol can not be printed. Consequently, numerals and function symbols can be printed with single print hammer. It is therefore unnecessary to dispose the two print hammers for printing numerals and for printing function symbols and to change between them in use as in the prior art, and the drive mechanism for the print hammer can be made simpler in construction than in the prior art. The simpler construction reduces faults, simplifies assemblage and permits inexpensive fabrication.

What is claimed is:

1. A serial printer comprising first and second type wheels mounted on a rotary shaft for axial movement into a printing position along a printing line and carrying a plurality of respective type elements positioned at said printing line by rotation of said shaft, a single hammer lying along said entire printing line and having a recess formed opposite a non-printing position on said printing line, means for placing said second type wheel in said non-printing position so as to be opposite said recess whenever type elements from said first type wheel are selected for printing and placing said first type wheel in said non-printing position so as to be opposite said recess whenever type elements from said second type wheel are selected for printing, means for moving said hammer towards said type wheels for printing a character corresponding to the selected type element, and a mask member held in position between said recess and said non-printing position.

2. A serial printer according to claim 1, said first type wheel carrying a plurality of type elements corresponding to various function symbols and adapted to be positioned at the first printing position along said printing line, and said second type wheel carrying a plurality of type elements corresponding to various numerals and adapted to be positioned initially at the second printing position along said printing line.

3. A serial printer according to either claim 1 or 2, further including a carriage movable axially along said shaft and carrying said second type wheel.

4. A serial printer according to claim 3, said carriage including a spacer member adapted to engage said first type wheel to maintain it at a minimum distance from said second type wheel.

5. A serial printer according to claim 4, said first type wheel having an initial position suitable for printing and said printer including a resilient member urging said first type wheel away from its initial printing position.

6. A serial printer according to claim 5, said carriage being urged towards its initial position by a spring element adapted to overcome the resilient force of said resilient member.

7. A serial printer according to claim 6, said recess being located between the initial printing position of said first type wheel and the initial printing position of said second type wheel.

8. A serial printer according to claim 1, said mask member being made of a flexible material and having a width at least equal to that of either of said type wheels.

9. A serial printer according to either of claim 1 or 8, wherein paper to be printed is adapted to be inserted between said hammer and said mask member.

10. A serial printer according to claim 1, said recess being located between the initial printing position of said first type wheel and the initial printing position of said second type wheel.

* * * * *